US007874962B1

(12) United States Patent
Pestes

(10) Patent No.: US 7,874,962 B1
(45) Date of Patent: Jan. 25, 2011

(54) WHEELCHAIR EXERCISE APPARATUS

(76) Inventor: Larry Pestes, 16007 SE. Amisigger Rd., Boring, OR (US) 97009

( * ) Notice: Subject to any disclaimer, the term of this patent is extended or adjusted under 35 U.S.C. 154(b) by 0 days.

(21) Appl. No.: 12/460,278

(22) Filed: Jul. 15, 2009

(51) Int. Cl.
*A63B 69/16* (2006.01)
*A63B 21/005* (2006.01)
*A63B 26/00* (2006.01)

(52) U.S. Cl. ..... 482/65; 482/51; 482/903; 482/904

(58) Field of Classification Search ..... 482/51, 482/57, 60, 61, 63–65, 110, 904, 903; 280/304.1; 73/379.06, 379.07, 115.07, 115.08
See application file for complete search history.

(56) References Cited

U.S. PATENT DOCUMENTS 1,525,278 A * 2/1925 Doglione ..... 463/68
2,709,362 A * 5/1955 Samuel et al. ..... 73/670
2,788,211 A * 4/1957 Ivanoff ..... 482/4
3,125,341 A * 3/1964 Carrington ..... 482/61
4,233,844 A * 11/1980 Dreisinger et al. ..... 73/379.06
4,911,425 A * 3/1990 Kynast et al. ..... 482/54
4,966,362 A * 10/1990 Ramaekers ..... 482/148
5,476,429 A * 12/1995 Bigelow et al. ..... 482/54
5,643,143 A * 7/1997 Burak et al. ..... 482/54
5,649,883 A * 7/1997 Mayes et al. ..... 482/54
5,704,876 A * 1/1998 Baatz ..... 482/4
5,709,631 A * 1/1998 Kleinsasser ..... 482/51
6,113,519 A * 9/2000 Goto ..... 482/54
6,645,127 B1 * 11/2003 Pestes ..... 482/60
6,716,143 B1 * 4/2004 Martin ..... 482/92
7,004,885 B1 * 2/2006 Wu et al. ..... 482/4
7,604,572 B2 * 10/2009 Stanford ..... 482/51

FOREIGN PATENT DOCUMENTS

JP 11332917 A * 12/1999

* cited by examiner

*Primary Examiner*—Loan Thanh
*Assistant Examiner*—Victor K Hwang
(74) *Attorney, Agent, or Firm*—Chernoff, Vilhauer, McClung & Stenzel, LLP

(57) ABSTRACT

A wheelchair exercise apparatus has a platform which will support a wheelchair. The platform has an elongate slot which the driving wheels of the wheelchair can drop slightly into. An elongate roller, having a central axis which is vertically below the center line of the slot, is movable between a lowered position where it is substantially below the upper surface of the platform and a raised position where it projects through the slot and extends partially above the upper surface of the platform. A locking system holds the wheelchair while the roller is being moved to its raised position and during the exercise period.

13 Claims, 4 Drawing Sheets

WHEELCHAIR EXERCISE APPARATUS

BACKGROUND OF THE INVENTION

Pestes, U.S. Pat. No. 6,645,127, discloses a wheelchair exercise apparatus in which a wheelchair is driven up a ramp onto a platform. A pair of side by side rollers, which extend above the platform, support the wheelchair driving wheels. A clamp mechanism holds the wheelchair immovably on the rollers. The rollers are connected to a flywheel which provides the momentum associated with actual wheelchair operation. One difficulty with this prior art apparatus is that elderly people or people who are new to using a wheelchair may have limited arm strength and overcoming the resistance caused by driving two rollers for an extended period of time may not be possible for them. However, it is very difficult to drive the driving wheels of a wheelchair up onto a single roller and lock it in place with the driving wheels centered on the roller.

SUMMARY OF THE INVENTION

The subject invention overcomes the problem with the prior art by providing a wheelchair exercise device having a platform that will support a wheel chair with an elongate slot extending across the platform substantially normal to the plane of the driving wheels of the wheelchair. An elongate roller is movable between a lowered position where it is substantially below the platform and a raised position where it projects through the slot and extends partially above the platform. The axis of the roller is directly below the center line of the slot so that when the driving wheels of the wheelchair are positioned in the slot they are centered above the roller. A locking mechanism holds the wheelchair in place once it is positioned in the slot. The roller is then moved to its raised position where it supports the driving wheels.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 1:
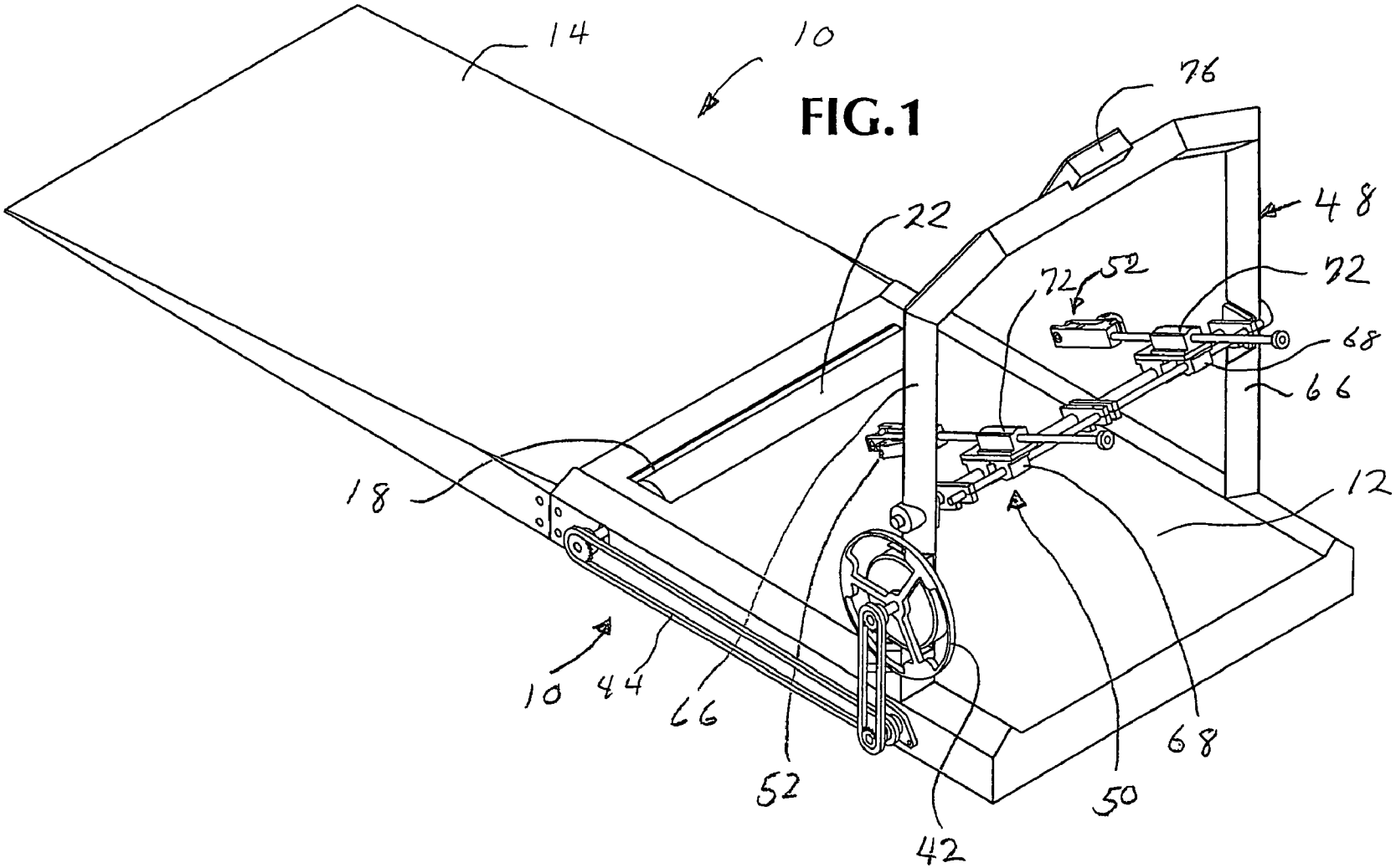
FIG. 1 is a prospective view of a wheelchair exercise apparatus embodying the subject invention.
Figure 2:
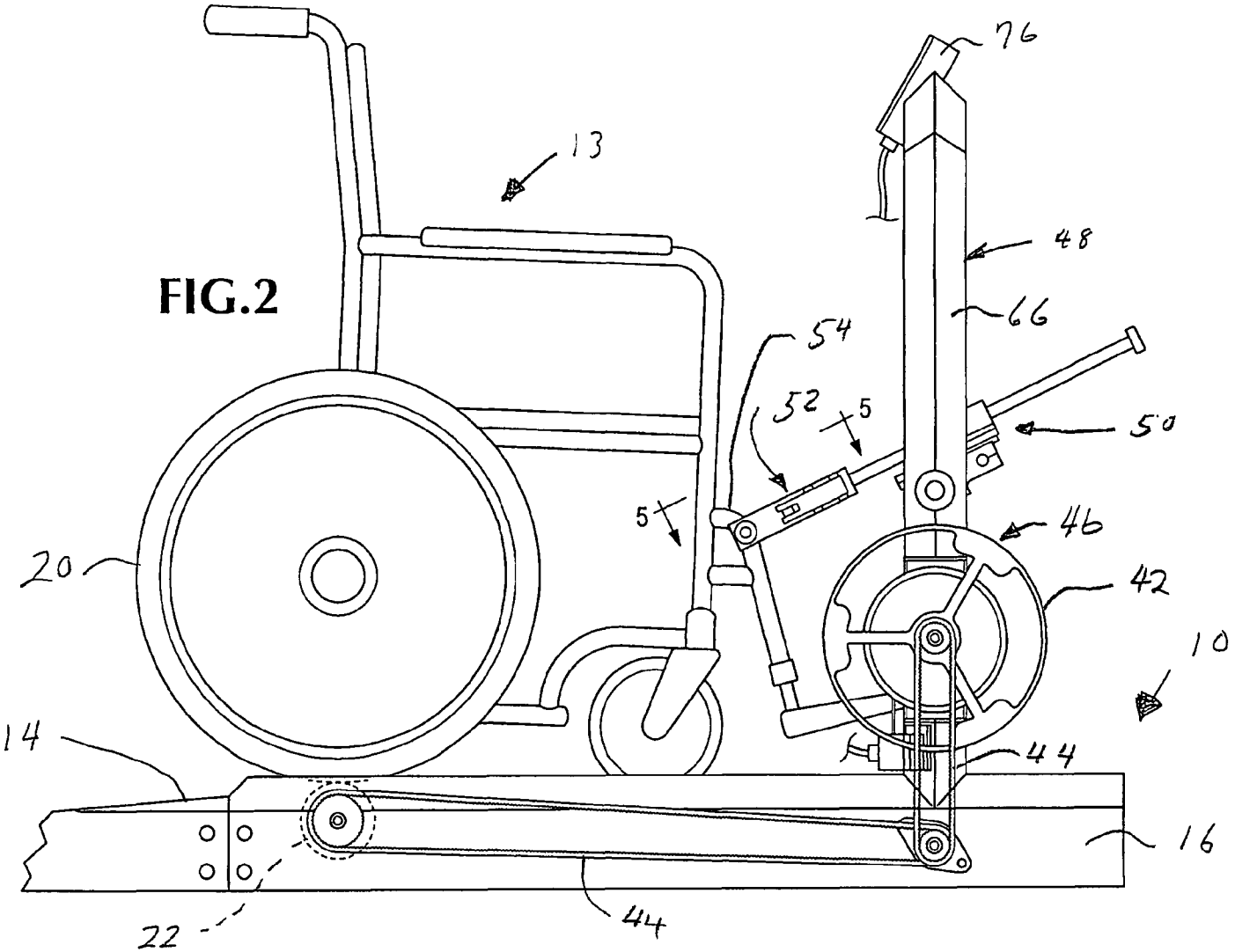
FIG. 2 is a fore-shortened side elevation view of the apparatus of FIG. 1 with a wheelchair in place.

Referring now to FIGS. 1 and 2 of the drawings, a wheelchair exercise apparatus 10 includes a raised platform 12 and a ramp 14 which allows a wheelchair 13 to be driven up onto the platform. The platform is supported by a rigid frame 16. A slot 18 is located in the platform 12 close to where the platform joins the ramp 14. The slot is generally perpendicular to the planes of the larger diameter driving wheels 20 of the wheelchair when the wheelchair is driven onto the platform.

Figure 4:
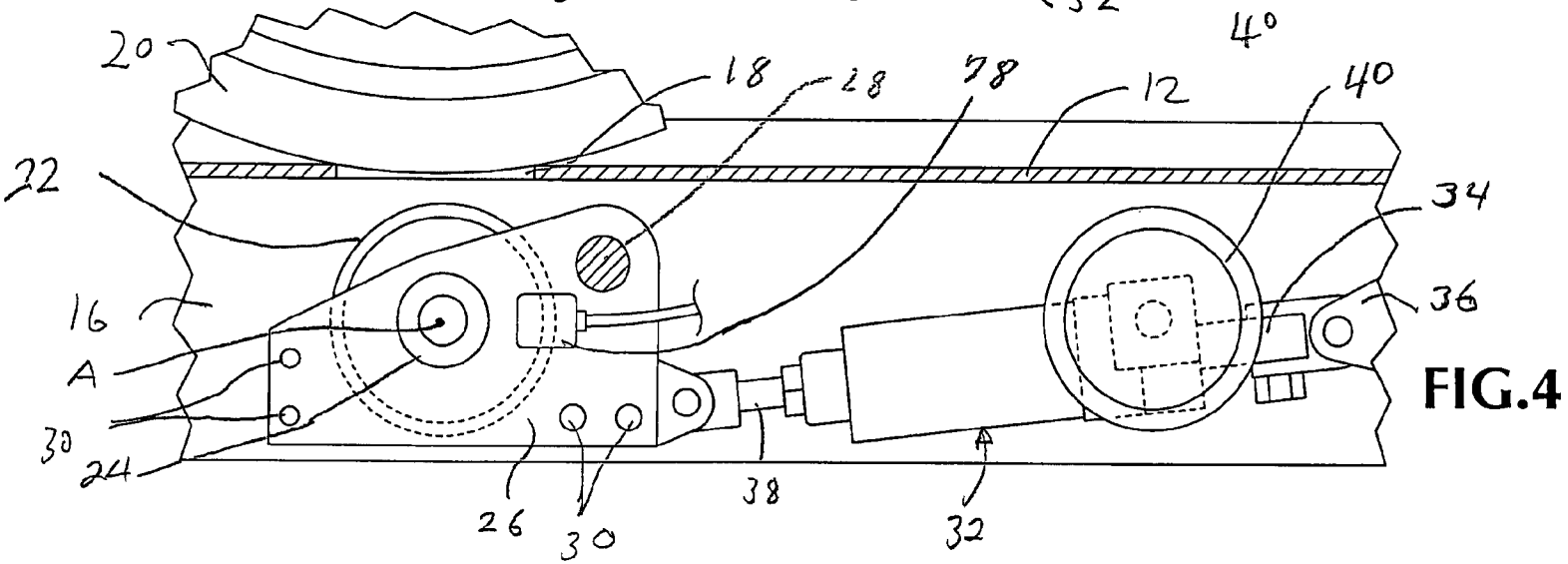

The slot has a width which the driving wheels can bridge and yet the bottoms of the driving wheels will drop slightly into the slot, FIG. 4. This essentially centers the driving wheels 20 over the center line of the slot 18.

Figure 3:
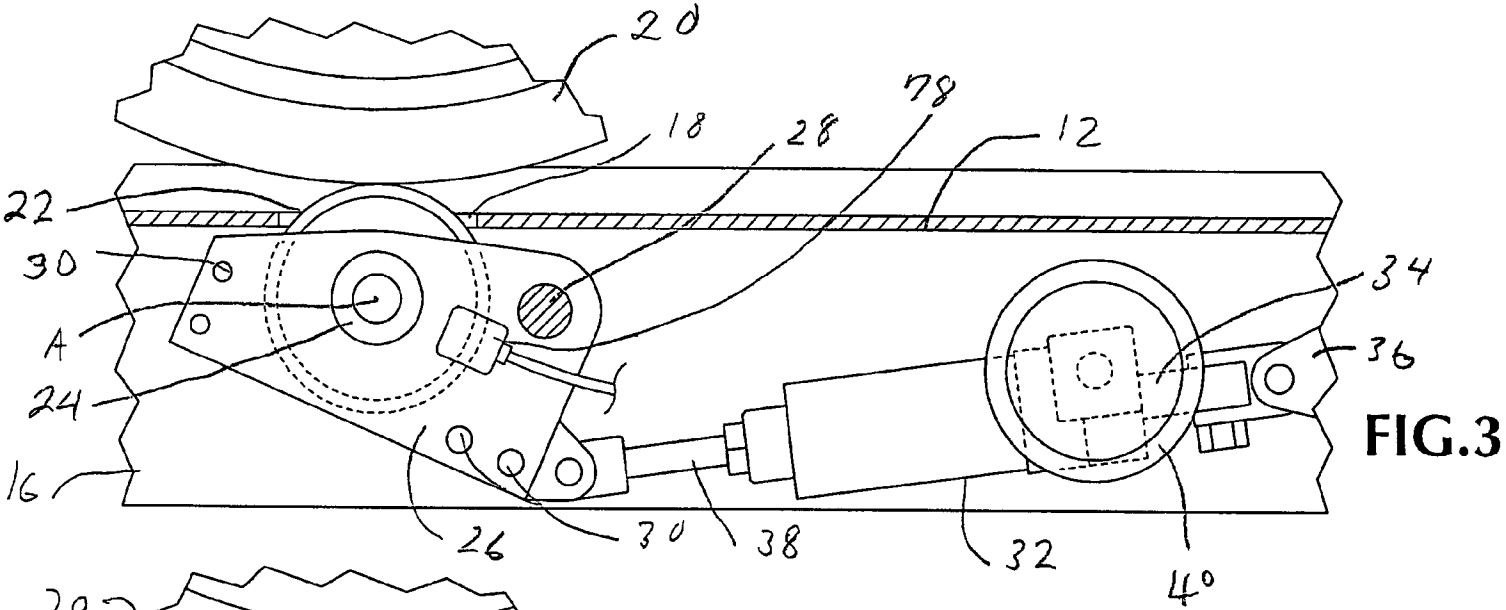
FIGS. 3 and 4 are side elevation views, partially broken away to show a hidden portion of the apparatus.

Referring now also to FIGS. 3 and 4, an elongate roller 22 has an axis which is parallel to the center line of the slot 18 and is located vertically below the center line of the slot. The roller 22 is journaled at each of its ends in bearings 24 which are mounted on rocker plates 26. The rocker plates 26 are rotatably mounted on posts 28 which are mounted on the frame 16. The rocker plates are rotatable between a first position, FIG. 4, where the roller is in a lowered position substantially below the upper surface of the platform 12, and a second position, FIG. 3, where the roller is in a raised position where it projects through the slot 18 and extends slightly above the upper surface of the platform 12. The rocker plates are connected to one another by tie bars 30 so that they rotate together. A linear actuator 32 has one end 34 which is rotatably attached to a clevis 36 mounted on the frame. An extensible piston 38 is located at the other end of the actuator. The piston 38 is movable between a retracted position, FIG. 4, where the rocker plate 26 places the roller is in its lowered position, and an extended position, FIG. 5, where the rocker plate places the roller is in its raised position. While any type of linear actuator could be used, a rack and pinion actuator powered by an electric motor 40 works well for this purpose. The roller 22 is connected to a flywheel 42 through a pulley system 44. The flywheel simulates the movement that a wheelchair would experience in a normal rolling operation. It also allows additional resistance to be provided to the roller 22. While there are many ways this resistance could be applied, in the preferred embodiment illustrated resistance is applied by means of a magnetic brake 46 located on the flywheel which allow precisely applying the desired amount of resistance.

Figures 5, 6:
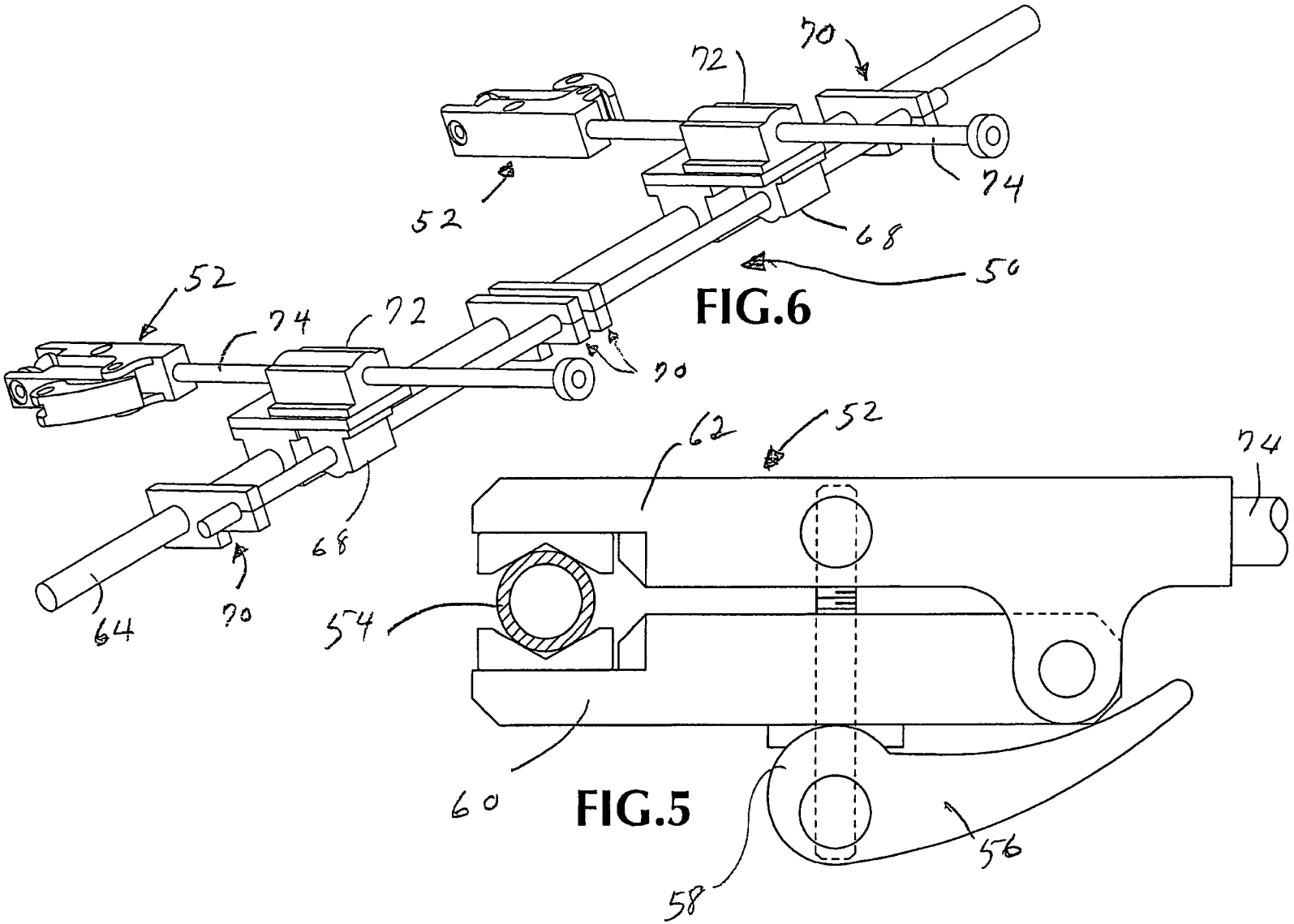
FIG. 5 is a side elevation view, at a larger scale, showing a clamp which is a feature of the subject invention.
FIG. 6 is a prospective view showing a locking mechanism which is a feature of the subject invention.

A support tower 48 extends upwardly from the frame 16 forward of the slot 18. In the embodiment illustrated the flywheel 42 is mounted on the support tower but it could be mounted elsewhere if desired. The support tower also carries a locking mechanism 50 which is used to prevent the wheelchair from moving when the roller is being moved to its raised position and when the wheelchair is being driven on the roller 22. Referring now also to FIGS. 5 and 6, the locking mechanism includes a pair of quick release clamps 52 which can be clamped to a desired component 54 of the wheelchair. A lever 56 operates a cam 58 to move a movable jaw 60 of the clamp relative to a fixed jaw 62 to provide the clamping action. A mounting rod 64 extends between the two legs 66 of the support tower 48. Mounted slidably and rotatably on the mounting rod 64 is a pair of first blocks 68, one for each clamp 52. Outriggers 70 mounted on each side of each first block allow the first blocks to rotate and slide on the mounting rod without binding. A second block 72 is mounted on each first block 68. The second blocks slidably carry clamp rods 74 which are perpendicular with the mounting rod 64. One of the clamps 52 is mounted on the extremity of each clamp rod 74. A lock (not shown) allows the clamp rods 74 to be locked in place in the second blocks. With the locks on the second blocks unlocked each set of first and second blocks 68, 72 can be rotated or slid sideways along the mounting rod 64, and the clamp rod 74 can be slid in and out of the second block 72. This gives the user complete freedom to attach the clamps 52 to a desired component 54 of the wheelchair 13. However, when the clamps 52 are attached and the locks on the second blocks 72 are locked, the entire locking mechanism becomes rigid and holds the wheelchair firmly in place.

If desired a control panel 76 can be mounted on the support tower 48. A sensor 78, which senses the rotational speed of the roller, is connected to the control panel to provide the user with a readout of the speed the wheelchair is simulating. The control panel 76 can also be used to start and stop the motor 40 and to move the roller between its lowered and raised positions. The control panel also can be used to control the brake 46 to set and see the level of resistance. Finally, the control panel can provide performance data, such as the elapsed time of an ongoing exercise and the user's heart rate.

In use with the roller 22 in its lowered position the wheelchair 13 is propelled up the ramp 14 onto the platform 12 with the driving wheels 20 positioned in the slot 18. The two clamps 52 are then attached to a suitable component 54 of the wheelchair and the locks on the second blocks 72 are locked. The roller 22 is then moved to its raised position and the exercise apparatus is ready to be used. As can be seen in FIG. 3, when the roller 22 is moved to its raised position it lifts the wheelchair driving wheels 20 off of the platform 12 and the driving wheels are supported entirely by the roller 22. Once in operation the user can increase or decrease the drag on the roller by manipulating the brake 46 on the flywheel 42.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. An exercise apparatus for a wheelchair having large diameter driving wheels, the exercise apparatus comprising:

a. a platform having an upper surface which will support a wheelchair;

b. an elongate slot having a center line which extends across said platform, said center line being substantially normal to planes defined by the wheelchair driving wheels when the wheelchair driving wheels are positioned in the slot for operation of the exercise apparatus;

c. said slot having a width which said driving wheels can bridge and will drop into;

d. an elongate roller having a central axis which is parallel with and substantially vertically below said center line, said roller mounted for movement between a lowered position where said roller is substantially below the upper surface of said platform and a raised position where said roller projects through said slot and extends partially above the upper surface of said platform where said roller lifts said wheelchair driving wheels off of said platform and supports both wheelchair driving wheels in a position above said platform, wherein said platform remains stationary while said wheelchair driving wheels are lifted off of said platform; and e. a locking mechanism which holds the wheelchair with its driving wheels on said roller when said roller is moved from its lowered position to its raised position.

2. The exercise apparatus of claim 1 including a lifting mechanism for moving said roller from its lowered position to its raised position when the driving wheels of said wheelchair are positioned in said slot.

3. The exercise apparatus of claim 2 including a frame which supports said platform, wherein said lifting mechanism comprises:

a. a pair of rocker plates which rotatably carry opposed ends of said roller;

b. said rocker plates being rotatably mounted on said frame;

c. said rocker plates being interconnected in a manner such that rotation of one of said plates causes the other plate to rotate therewith;

d. an actuator which rotates said plates between a first position where said roller is in its lowered position and a second position where said roller is in its raised position.

4. The exercise apparatus of claim 3 wherein said actuator is driven by an electric motor.

5. The exercise apparatus of claim 4 wherein said actuator is a linear actuator.

6. The exercise apparatus of claim 1 wherein said locking mechanism comprises:

a. a pair of quick release clamps which can be clamped to a frame element of said wheelchair;

b. an alignment mechanism which supports said clamps and allows said clamps to be appropriately positioned to be clamped to a suitable frame element and which can be locked to hold the clamps in this position.

7. The exercise apparatus of claim 1 including a flywheel which is rotatably driven by the rotation of said roller.

8. The exercise apparatus of claim 7 including a brake, associated with said flywheel, which resists the rotation of said flywheel.

9. The exercise apparatus of claim 8 wherein said brake is a magnetic brake.

10. The apparatus of claim 9 including a control system which allows someone sitting in said wheelchair to move said roller between its raised and lowered positions and to actuate said brake.

11. An exercise apparatus for a wheelchair having large diameter driving wheels, the exercise apparatus comprising:

(a) a platform having an upper surface which will support a wheelchair;

(b) an elongate slot having a center line which extends across said platform substantially normal to planes defined by the wheelchair driving wheels;

(c) said slot having a width which said driving wheels can bridge and will drop into;

(d) an elongate roller having a central axis which is parallel with and substantially vertically below said center line, said roller being movable between a lowered position where it is substantially below the upper surface of said platform and a raised position where it projects through said slot and extends partially above the upper surface of said platform;

(e) a locking mechanism which holds the wheelchair with its driving wheels on said roller when said roller is moved from its lowered position to its raised position;

(f) a frame which supports said platform; and (g) a lifting mechanism for moving said roller from its lowered position to its raised position when the driving wheels of the wheelchair are positioned in said slot, wherein said lifting mechanism comprises:

(i) a pair of rocker plates which rotatably carry opposed ends of said roller;

(ii) said rocker plates being rotatably mounted on said frame;

(iii) said rocker plates being interconnected in a manner such that rotation of one of said plates causes the other plate to rotate therewith; and (iv) an actuator which rotates said plates between a first position where said roller is in its lowered position and a second position where said roller is in its raised position.

12. The exercise apparatus of claim 11 wherein said actuator is driven by an electric motor.

13. The exercise apparatus of claim 12 wherein said actuator is a linear actuator.

* * * * *